United States Patent [19]

Yang

[11] 4,441,223

[45] Apr. 10, 1984

[54] HEALTHFUL QUILT

[76] Inventor: Ling-Kuo Yang, No. 1, Lane 23, Hsien Cheng St., Tainan, Taiwan

[21] Appl. No.: 363,478

[22] Filed: Mar. 30, 1982

[51] Int. Cl.[3] ..... A47G 9/02

[52] U.S. Cl. ..... 5/494; 5/501

[58] Field of Search ..... 5/482, 485, 494, 501, 5/502, 500, 424, 413; 128/134

[56] References Cited

U.S. PATENT DOCUMENTS

| | | | |
|---|---|---|---|
| 921,439 | 5/1909 | McGowan | 5/494 |
| 1,291,191 | 1/1919 | Semple | 5/494 |
| 1,735,521 | 4/1929 | Young | 128/134 |
| 1,802,540 | 4/1931 | Schmidt | 128/134 |
| 2,888,009 | 5/1959 | Taylor | 128/134 |

*Primary Examiner*—Alexander Grosz
*Attorney, Agent, or Firm*—Holman & Stern

[57] ABSTRACT

The healthful quilt comprises a cotton sheet, natural of synthetic, and a cover. Near one end of both the cotton sheet and the cover is cut a long head hole, of the same size and at the same location, through which a human head can pass from under the quilt. Then the head can rest and press on the end part of the quilt, and the body can be covered by the rest of the quilt.

There are two flaps stitched beside the long head hole on the cover, one on the upper side and other on the under side. These flaps can cover the long head hole to make a common conventional quilt or can be placed through the hole with one end fastened together with the other side by means of hooks and eyes to keep the head hole open for the sleeper's head to pass through. Then the sleeper's head presses a part of the quilt, keeping it always covering his body without falling down in spite of his body's movement, so that the sleeper can always be kept warm.

1 Claim, 10 Drawing Figures

HEALTHFUL QUILT

BACKGROUND OF THE INVENTION

Quilts are indispensable for sleeping in our daily life, but we do not generally pay much attention to them. As common conventional quilts are not of the structure that can secure the sleeper's body under them, the sleeper's body can often be exposed to air because of the quilt's falling down his body by his unconscious turning right or left during sleeping. Especially, young children may easily kick their quilts aside and catch cold, as we know. In order to get rid of parents' worries like this, the invention provides a healthful quilt.

BRIEF DESCRIPTION OF THE DRAWING

So that this invention may be clearly understood, an embodiment thereof is described by way of example with reference to the accompanying Drawing in which.

DETAILED DESCRIPTION OF THE DRAWING

Figure 1:
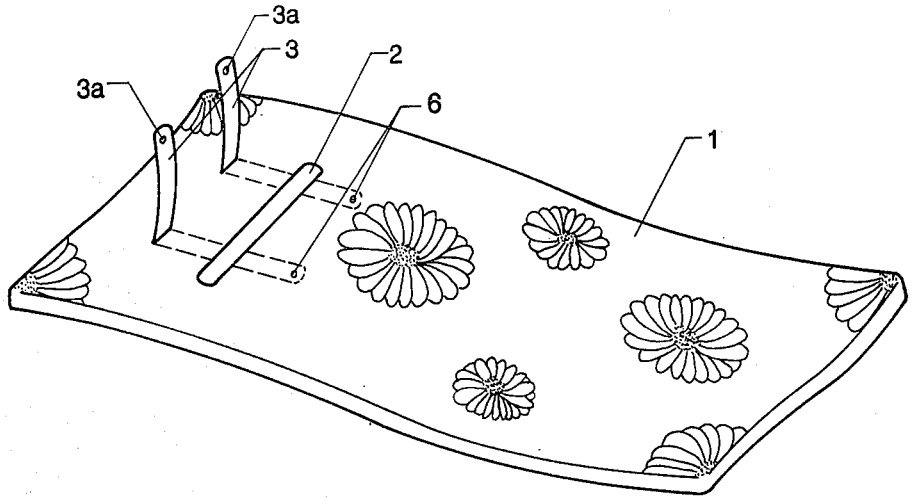
FIG. 1 is an upper side view of the cotton sheet of a quilt according to this invention.
Figure 2:
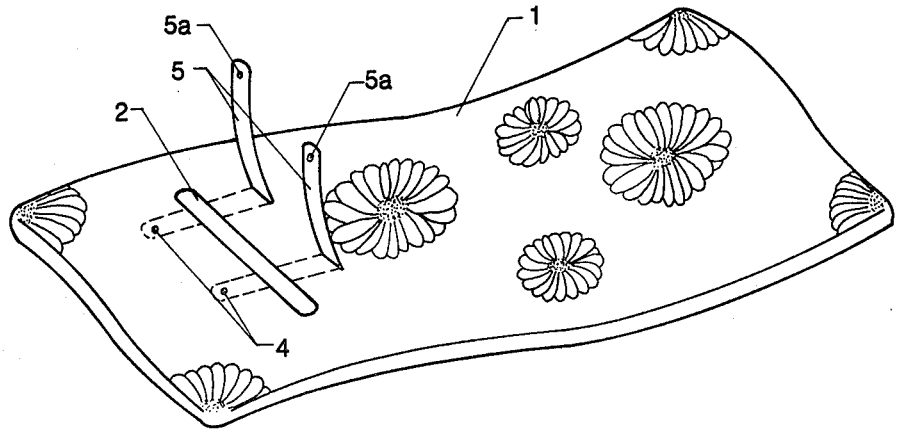
FIG. 2 is an under side view of the cotton sheet of FIG. 1.
Figure 3:
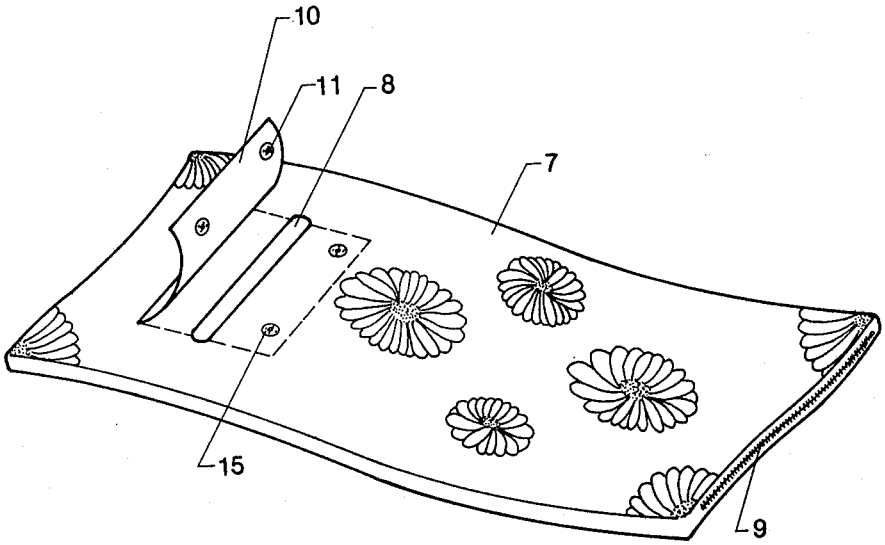
FIG. 3 is an upper side view of the cover of a quilt according to this invention.
Figure 4:
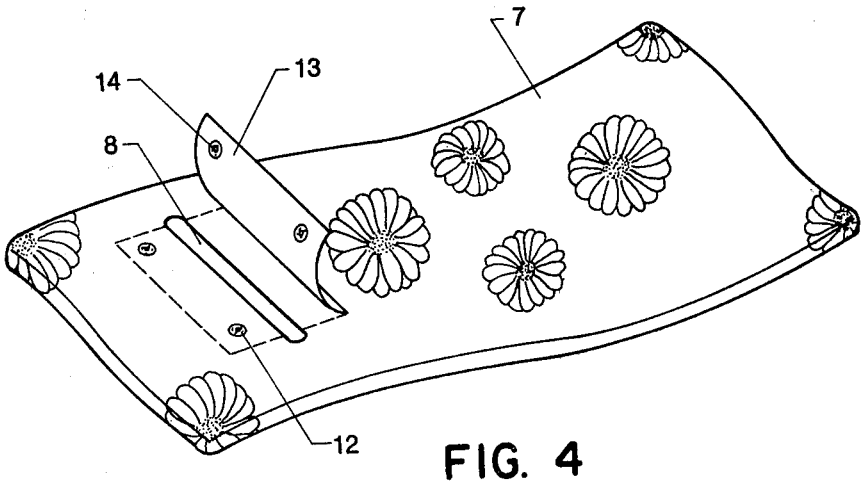
FIG. 4 is an under side view of the cover of FIG. 3.

The healthful quilt consists of a cotton sheet (1) and a cover (7) (FIGS. 3 and 4). The cotton sheet (1), shaped rectangularly, is made up of natural or synthetic cotton with the cover (7) wrapping around the cotton. Near one end of the cotton sheet (1) is cut a long head hole (2) for user's head to pass through. At the left side of the long head hole (2) are sewn two bands (3) on the upper side of the cotton sheet (1); at the tip of each band is a button hole **(3*a*), through which buttons (6) fixed on the right side of the head hole (2) can pass; on the under side of the cotton sheet (1) are also sewn two bands (5) at the right side of the head hole (2); at the tip of each band is a button hole (5*a*), through which buttons (4)** can pass.

Figure 5:
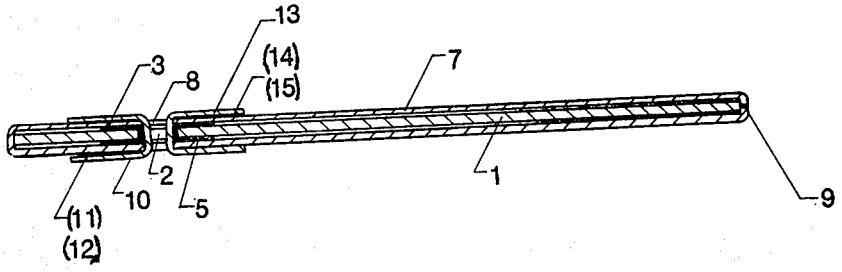
FIG. 5 is a structural cross sectional view of the quilt according to the invention with its head hole open.
Figure 6:
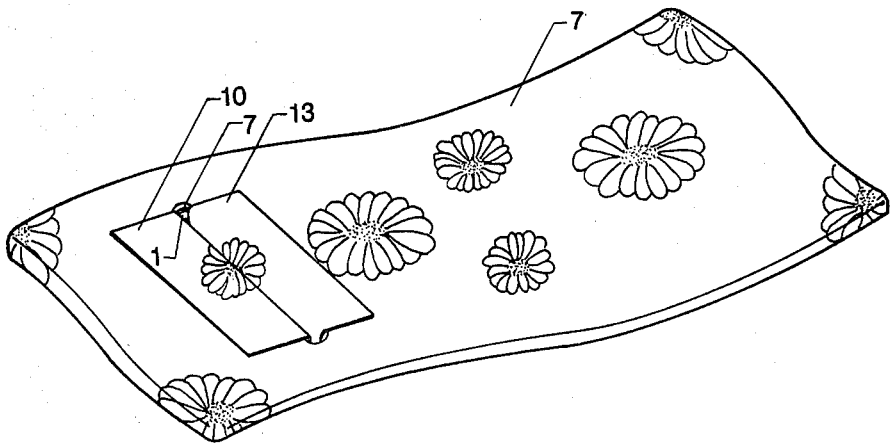
FIG. 6 is a perspective view of the quilt according to the invention with the head hole open.

Provided that this quilt is to be used with its head hole (2) open, as FIGS. 5 and 6 show, the bands (3) on the upper side of the cotton have to be passed through the head hole (2), and the button holes **(3*a*) have to be fastened with the buttons (4) on the under side of the cotton sheet (11). Likewise, the bands (5) have to be passed through the head hole (2) and the button holes (5*a*) are to be fastened with the buttons (6)**.

Figure 7:
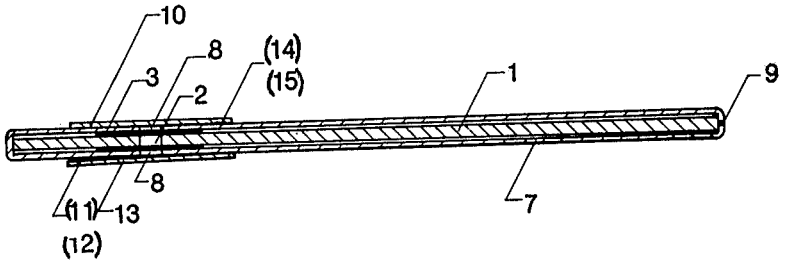
FIG. 7 is a structural cross sectional view of the quilt according to the invention with the head hole covered.
Figure 8:
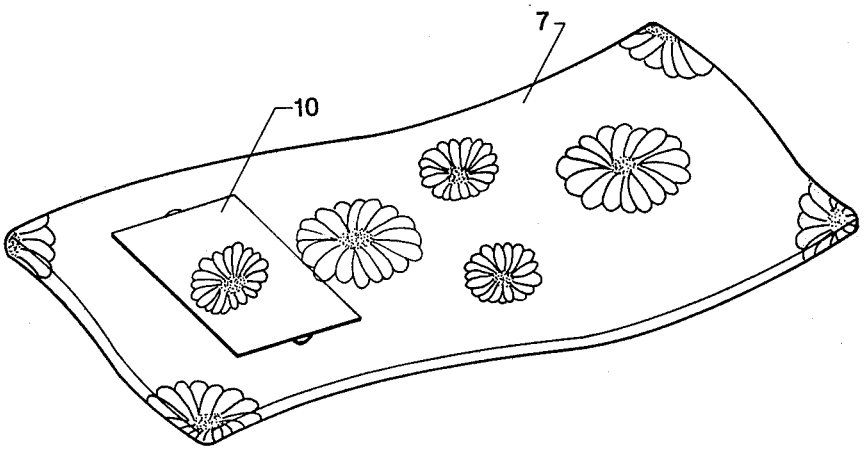
FIG. 8 is a perspective view of a quilt according to the invention with the head hole covered.
Figure 9:
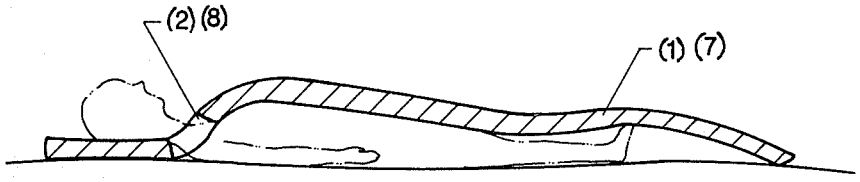
FIG. 9 is a cross-sectional view of a quilt according to the invention with its head hole open in practical use.
Figure 10:
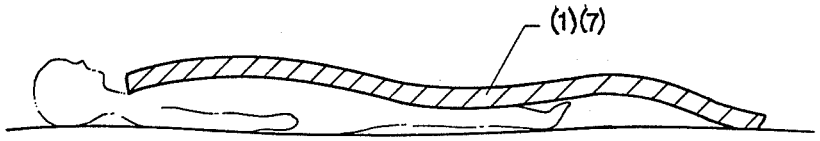
FIG. 10 is a cross-sectional view of a quilt according to the invention with the head hole covered, in practical use.

On the contrary, FIGS. 7 and 8 show the way this quilt is used with the head hole covered. The bands (3) are put across the head hole (2) and the button holes **(3*a*) are fastened with the buttons (6); likewise, the bands (5) are put across the head hole (2) and the button holes (5*a*) are fastened with the buttons (4)**. In this way, this quilt can be used as a common conventional one, because the head hole is covered and hidden inside unusable.

The cover (7) of this quilt (FIGS. 3 and 4), is made of cloth, and is almost the same size as the cotton sheet (1). There is a zipper (9) on one end through which the cotton sheet (1) is pushed inside by opening the zipper (9). Near one end of the cover (7) is cut a long head hole (8) just the same size of the head hole (2) in the cotton sheet (1). At the left side of the head hole (8) on the upper side of the cover (7) is stitched one end of a cloth flap (10), and on the other side of the flap (10) are sewn two hooks (11); on the right side of the head hole (8) are sewn two eyes (15). Likewise, on the under side of the cover (7) is sewn one end of a flap (13), and on the other end of the flap (13) are sewn two hooks (14); on the left side of the head hole (8) are sewn two eyes (12).

If this quilt is to be used with its head hole open, the flap (10) on the upper side of the quilt has to be passed through the head hole (8) of the cover (7) and the head hole (2) of the cotton sheet (1), with the hooks (11) fastened with the eyes (12); likewise, the flaps (13) on the under side of the quilt has to be passed through the head hole (8) of the cover (7) and the head hole (2) of the cotton sheet (1), with the hooks (14) fastened with the eyes (15). FIGS. 5 and 6 show the way mentioned above. Then the user can pass his or her head through the head holes (2, 8) to permit his or her neck to be surrounded by the head holes (2, 8) and his or her head to rest on the upper end of the quilt. Consequently, the quilt can not slip down the body no matter how the user may turn under the quilt.

In case this quilt is used with its head hole covered, the flap (10) on the upper side of the quilt has to be covered over the head hole (8) with the hooks (11) fastened with the eyes (15); likewise, the flap (13) on the under side of the quilt has to be covered over the head hole (8) with hooks (14) fastened with the eyes (12). Then the head holes (2, 8) are completely covered and closed, so this quilt can be used the same as a common conventional one.

What is claimed is:

1. A kind of quilt consisting of a cotton sheet and a cover wrapping around the cotton sheet; both the cotton sheet and the cover equipped with a long head hole on one end of them, of the same size and at the same location for a user's head to pass through; the cotton sheet having two bands and two buttons and two button holes sewn on the upper and under sides near the head hole; the cover having two flaps and two hooks and two eyes sewn both on the upper and under sides near the head hole; the bands, the buttons, the button holes, the flaps, the hooks, and the eyes, all serving for covering or uncovering the head hole for two ways of use.

* * * * *